US009062557B2

(12) United States Patent
Tham et al.

(10) Patent No.: US 9,062,557 B2
(45) Date of Patent: Jun. 23, 2015

(54) FLOW DISCOURAGER INTEGRATED TURBINE INTER-STAGE U-RING

(75) Inventors: Kok-Mun Tham, Orlando, FL (US); Ching-Pang Lee, Cincinnati, OH (US); Abdullatif M. Chehab, Chuluota, FL (US); Gm Salam Azad, Oviedo, FL (US); Shantanu P. Mhetras, Orlando, FL (US); Manjit Shivanand, Orlando, FL (US); Vincent P. Laurello, Hobe Sound, FL (US); Christopher Rawlings, Stuart, FL (US)

(73) Assignee: Siemens Aktiengesellschaft, München (DE)

( * ) Notice: Subject to any disclaimer, the term of this patent is extended or adjusted under 35 U.S.C. 154(b) by 933 days.

(21) Appl. No.: 13/226,547

(22) Filed: Sep. 7, 2011

(65) Prior Publication Data

US 2013/0058756 A1 Mar. 7, 2013

(51) Int. Cl.

| | |
|---|---|
| ***F01D 1/02*** | (2006.01) |
| ***F01D 11/00*** | (2006.01) |
| *F01D 11/04* | (2006.01) |

(52) U.S. Cl.

CPC ..... *F01D 11/001* (2013.01); *F01D 11/04* (2013.01)

(58) Field of Classification Search

CPC ..... F01D 11/001; F01D 11/02; F01D 11/04; F01D 25/12; F01D 5/08; F01D 11/00

USPC ..... 415/1, 115, 176, 178, 180

See application file for complete search history.

(56) References Cited

U.S. PATENT DOCUMENTS

| | | | | |
|---|---|---|---|---|
| 5,488,825 | A * | 2/1996 | Davis et al. | 60/806 |
| 6,558,114 | B1 * | 5/2003 | Tapley et al. | 415/111 |
| 7,052,240 | B2 | 5/2006 | Race | |
| 7,507,069 | B2 * | 3/2009 | Kizuka et al. | 415/199.5 |

* cited by examiner

*Primary Examiner* — Nathaniel Wiehe
*Assistant Examiner* — Woody A Lee, Jr.

(57) ABSTRACT

A gas turbine having rotor discs (9), a disc cavity (13) and a stator stage (25) extending to the disc cavity (13). Seal housing flanges (43, 44) extend from a seal housing (29) of the stator stage (25). Rotor flanges (41*i*, 41*o*) extend from a rotor disk (9-1). An inner rotor flange (41*i*) and first seal housing flange (43) are inward from a second seal housing flange (44). One rotor flange (41*o*) is outward from the second seal housing flange (44). The inner rotor flange (41*i*) and first seal housing flange (43) extend toward one another to limit movement of main gas flow (17). An inlet (47) injects air (50) between the outward rotor flange (41*o*) and second seal housing flange (44).

9 Claims, 2 Drawing Sheets

FLOW DISCOURAGER INTEGRATED TURBINE INTER-STAGE U-RING

FIELD OF THE INVENTION

This invention relates to gas turbines in which cooling air is introduced into the interstage disc cavities containing the stator to rotor shaft seals. More particularly, it relates to an arrangement which substantially confines the ingress of hot main gas flow into the interstage disc cavities to regions capable of withstanding high temperatures, thereby reducing the cooling air requirements to provide increased turbine efficiency.

BACKGROUND OF THE INVENTION

Gas turbines such as those used to drive electric power generators have a number of rotor discs axially spaced along a rotor shaft to form interstage disc cavities. Designs for these components are varied. See, for example, U.S. Pat. Nos. 7,052,240 and 6,668,114 each incorporated herein by reference. Generally, the stages of the stator extend radially inward from the turbine casing into the interstage disc cavities. Each stator stage includes a number of stator vanes secured to the turbine casing and a seal assembly which seals against the rotor discs to prevent main gas flow from bypassing the vanes.

The combination of each stator section with the upstream and downstream rotor discs forms annular disc cavities. Cooling air bled from the compressor is introduced into the interstage disc cavities to cool and purge the seal assemblies. Typically, the cooling air flows axially and radially outward through the disc cavities and passes outward through a rim seal into the main gas flow.

Despite the provision of the rim seal and an adjoining rim seal cavity about the exit of the disc cavity, it is common for some of the main gas flow to at times ingress into the disc cavities. For example, pressure variations induced by the rotating parts may cause recirculation of gases within the cavities, and this can draw the very hot main gas flow toward the stator, rendering components vulnerable to thermal damage. Sufficient cooling gas must be provided in order to protect the rotor seals from the hot main gas ingress. This reduces the overall efficiency of the gas turbine.

There is a need, therefore, for an improved interstage disc cavity design in a gas turbine which provides greater protection from thermal damage and which results in improved operating efficiency. More particularly, there is a need for a reduction in the volume of cooling air needed to cool components in the interstage disc cavities of a gas turbine. It is desirable that such a design will reduce the amount of heating which may occur within the interstage disc cavities of a gas turbine due to ingress of main gas flow.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
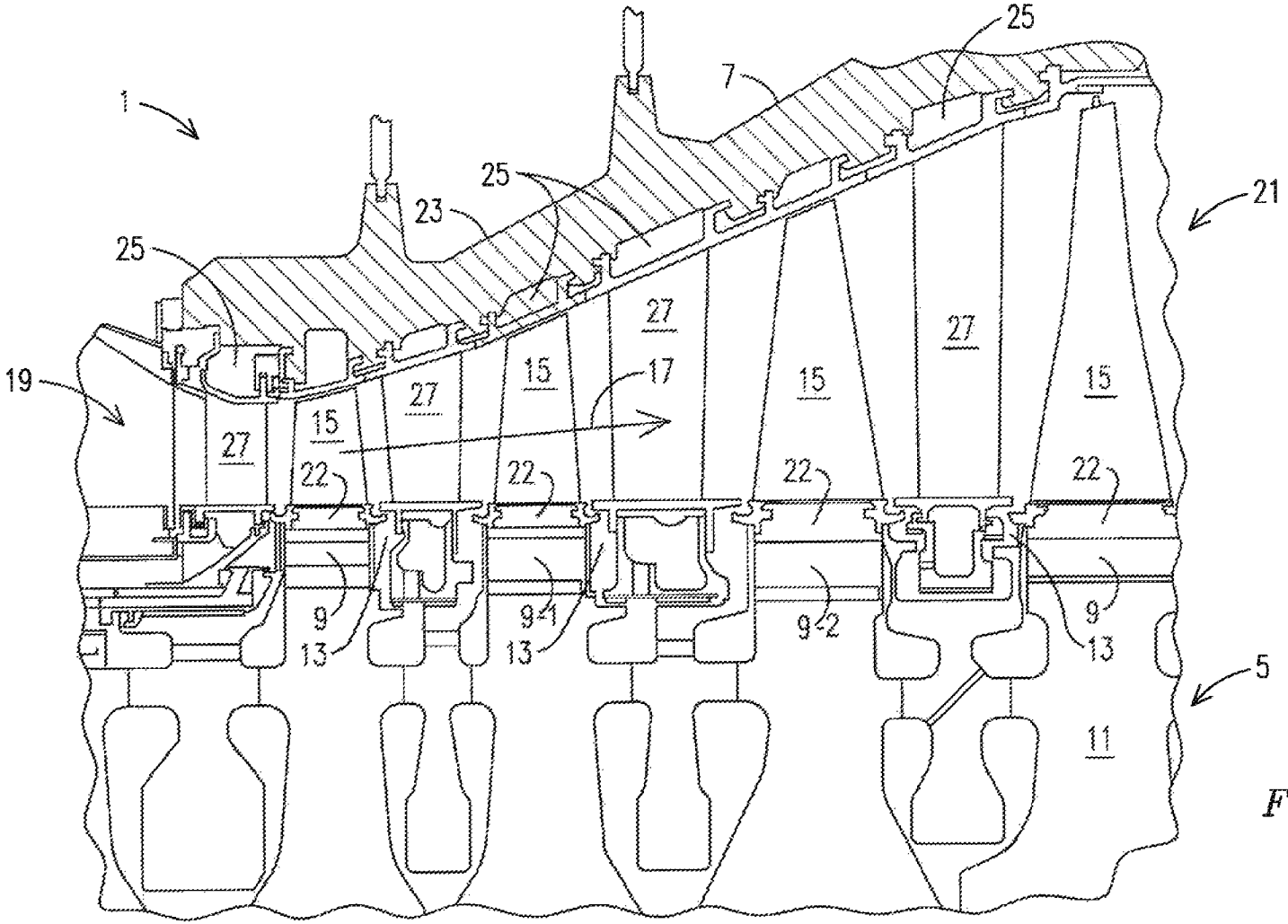
FIG. 1 is a partial longitudinal sectional view through a gas turbine incorporating the invention.
Figure 2:
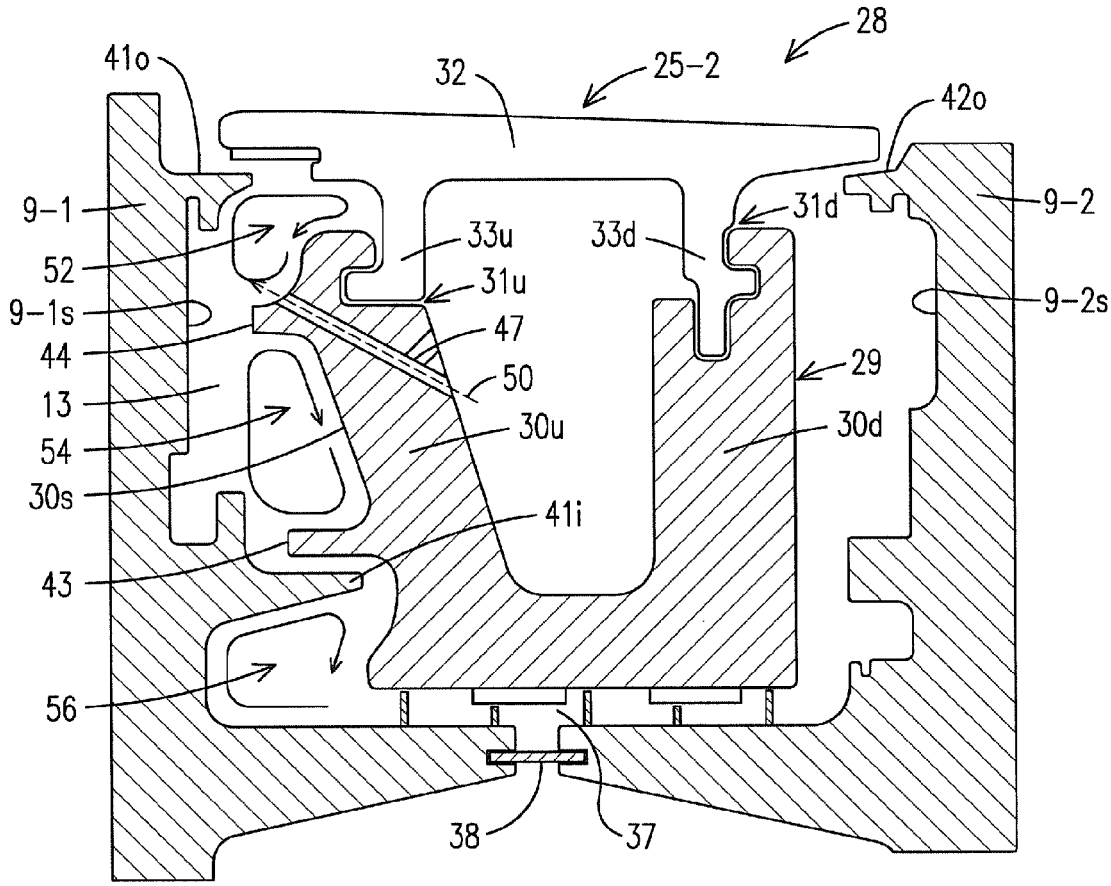
FIG. 2 is an enlarged view of a section of the gas turbine shown in FIG. 1, illustrating structure about an interstage disc cavity.

Referring to FIGS. 1 and 2, there is shown a section of a gas turbine 1 in which a rotor 5 is mounted for rotation within a turbine casing 7. The rotor 5 has a number of rotor discs 9 axially spaced along a rotor shaft 11 to form interstage disc cavities 13. Two of the discs 9 are annotated 9-1 and 9-2 to denote two discs shown in FIG. 2. Numerous details of the rotor discs and the disc cavities are not shown in FIG. 1 and are not relevant to the present invention. Each of the discs includes a number of rotor blades 15 each extending radially outward toward the turbine casing 7. The blades 15 extend into the main gas flow path 17 which extends from the turbine inlet 19 toward the turbine outlet 21. Each blade 15 is secured to a rotor disc 9 through a platform 22 and a dovetail (not shown).

The gas turbine 1 also includes a stator 23 having a number of stator stages or sections 25, each extending radially inward from the turbine casing 7 into the interstage disc cavities 13. Each of the stator sections 25 includes a plurality of stator vanes 27 secured to the turbine casing 7 in axial alignment with the main gas flow 17 and the rotor blades 15. As best viewed in FIG. 2, the stator sections 25 each include a seal assembly 28 integrally formed about a portion of an adjoining upstream rotor disc 9-1, including an associated blade platform 22 and about a portion of an adjoining downstream rotor disc 9-2, which also includes a portion of an adjoining blade platform 22. As shown in FIG. 2, the illustrated stator section comprises a second stage stator section 25-2 positioned between the upstream first stage rotor disc 9-1 and the downstream second stage rotor disc 9-2. The seal assembly 28 further comprises a U-ring interstage seal housing 29 and associated flanges. The foregoing details and other features of the invention described with reference to FIG. 2 are features of the other rotor discs, cavities and seal assemblies in other stages of the gas turbine 1 shown in FIG. 1.

Each interstage seal housing 29, being of a U shape, comprises upstream and downstream arms, 30*u* and 30*d*. Each arm extends radially outward from an innermost position along the rotor 5. See FIG. 1. The first arm 30*u* is closest to the first stage rotor disc 9-1 and the second arm 30*d* is closest to the second stage rotor disc 9-2. The upstream arm 30*u* has a first clevis 31*u* adjacent an outermost radial position thereof, and the downstream arm 30*d* has a second clevis 31*d* adjacent an outermost radial position thereof. The associated vane 27 includes an inner shroud 32 for attachment of the seal housing 29 to the vane. The inner shroud 32 of the vane comprises an upstream flange 33*u* and a downstream flange 33*d*, each extending in an inward radial direction and positioned for sliding and mating engagement within a clevis 31*u* or 31*d*. The upstream flange 33*u* is configured for such attachment within the first clevis 31*u* and the downstream flange 33*d* is configured for a similar type of attachment within the second clevis 31*d*. Thus the seal housing 29 is securely attached to the second stage stator section 25-2 by effecting mating engagement of each flange 33*u*, 33*d* within a corresponding one of the clevises 31*u*, 31*d* thereby attaching the housing 29 to the vane 27. Such attachment is effected with suitable clearance between the stator vane 27 and the rotor shaft 11 that the seal assembly 28 is spaced apart from the rotor shaft 11. A labyrinth seal 37, carried by the interstage seal housing 29 and/or the rotor shaft, provides a seal between the housing 29 and the shaft 11. An annular bellyband seal ring 38 is positioned radially inward of the labyrinth seal 37, connecting radially inner portions of the rotor discs 9-1 and 9-2.

A rotor inner flange 411 extends in a downstream direction from the first stage rotor disc 9-1 at a mid position along the rotor disc. A relatively smaller rotor outer flange, functioning as a rim seal 41*o*, extends in a downstream direction from near an outermost portion of the first stage rotor disc 9-1. Each of the flanges 411 and 410 is along a surface 9-1*s* of the disk 9-1 which faces the upstream arm 30*u* of the seal housing 29. A relatively small rotor outer flange, also functioning as a rim seal 42*o*, extends in an upstream direction from near an outermost portion of the second stage rotor disc 9-2. The rim seals 41*o* and 42*o* are circumferentially continuous flanges which each restrict a portion of the main gas flow 17 from entering the cavity 13, i.e., the region between the blade rotor discs 9-1, 9-2 and the U-ring interstage seal housing 29. The flange 41*i* and rim seals 41*o*, 42*o* may be integrally formed, e.g., via a casting process, along the rotor disc surfaces.

A first seal housing flange, operating as a first flow discourager flange 43, is located in a mid position along the seal housing upstream arm 30*u*. The flange 43 extends outward from the arm 30*u* in an upstream direction in close proximity to the rotor inner flange 411. The flange 43 thereby further limits hot gas of the main flow 17 from traveling through the labyrinth seal 37. A second seal housing flange, operating as a second flow discourager flange 44, is located near an outermost radial position of the upstream arm 30*u*. The flange 44 also extends outward from the arm 30*u* in an upstream direction. The discourager flanges 43, 44 are circumferentially continuous flanges which extend about the rotor 11.

Figure 3:
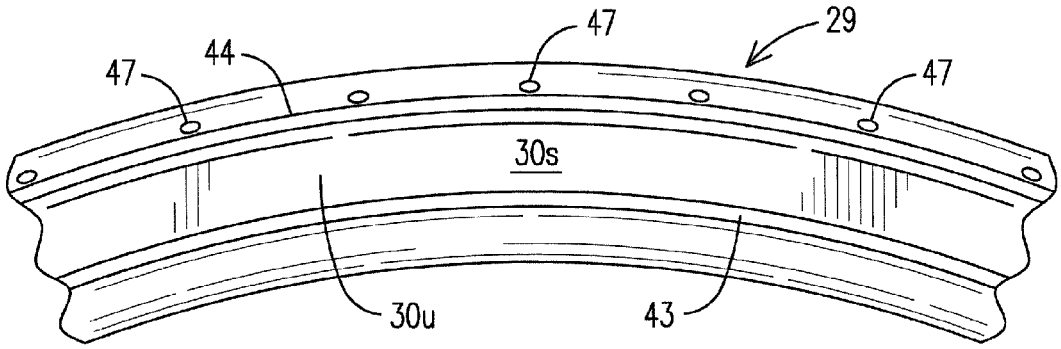
FIG. 3 is an axial view of the gas turbine shown in FIG. 1 illustrating features of the invention.

In accord with an embodiment of the invention, cooling air bled from the compressor (not shown) is introduced through the stator vanes (not shown) into interstage disc cavity regions (the disc cavities 13) through cooling air inlets such as shown in FIG. 2. Air inlets 47 which receive cooling air 50 bled from the compressor, are positioned in the upstream arm 30*u* of the seal housing 29. See, also, FIG. 3. The inlets are positioned adjacent to and radially outward from the flow discourager 44 to inject the cooling air 50 in a first subregion 52 of the cavity 13 between the dicourager 44 and the rim seal 41*o*. Although not shown in the figures, the air inlets 47 may be angled relative to the major axis of the turbine to introduce the cooling air into the cavity 13 in the direction of disc rotation. An arrow placed in the designated subregion 52 of FIG. 2 indicates a circular flow characteristic which results from introduction of the cooling air 50 into the subregion 52. The cooling air further flows into a second subregion 54 of the cavity 13 which adjoins the subregion 52 between the first and second flow discouragers 43 and 44. An arrow placed in the designated subregion 54 of FIG. 2 indicates a circular flow characteristic which results from introduction of the cooling air 50 into the subregion 54. A third subregion 56 also receiving the cooling air 50 is illustrated in FIG. 2 as extending between the flange 41*i* and the labyrinth seal 37, and also as having a circular flow characteristic. The cooling air 50 further progresses through the seal 37 and along the blade rotor disc 9-2.

The seal assembly 28 is a combination of components, including (i) the interstage seal housing 29, positioned in the disc cavity 13 and having a seal housing surface 30*s* spaced away from the surface 9-1*s* of the first stage rotor disc 9-1, (ii) a portion of the first stage rotor disc 9-1 having a surface 9-1*s* which faces the upstream arm 30*u* of the housing 29 and extends along the subregions 52, 54 and 56 of the disc cavity 13 from the labyrinth seal 37 at least to the rim seal 41*o*, and (iii) a portion of the second stage rotor disc 9-2 having a surface 9-2*s* which faces the downstream arm 30*d* of the seal housing 29 and extends along a portion of the disc cavity 13 from the labyrinth seal 37 at least to the rim seal 42*o*. Along the surface 9-1*s*, between the labyrinth seal 37 and the rim seal 41*o*, the combination of the rotor inner flange 41*i* and discourager flange 43 are in close proximity to one another to thereby restrict flow 17 from movement toward the labyrinth seal 37. Further, with the discourager flange 44 positioned radially outward with respect to the flange 43, the air inlet extends through the upstream arm 30*u* of the seal housing 29 to inject cooling air 50 in the subregion 52 of the cavity 13 which is between the discourager flange 44 and the rim seal 41*o*.

With the arrangement of discouragers 43 and 44 and the air inlet 47 positioned to inject cooling air into the first subregion 52, ingress of hot gas from the main flow 17 into the cavity 13 is limited and hot gas which enters the cavity is diluted by the injected cooling air, this resulting in a lower temperature as the air and hot gas mix in the circular flow path of the subregion 52. With the purge flow pressure, i.e., the relative pressure of the cooling air 50, higher than the pressure of the hot gas flow, the purge air mixes directly with the ingested hot gas to provide effective cooling to the rotor disc. The hot gas ingested into the cavity 13 is largely contained in the first subregion 52 which is a radially outermost recirculation zone. With the foregoing features, the purge flow requirement can be reduced while maintaining a sufficiently cool thermal environment to sustain the longevity of components, thereby providing for improved efficiency of turbine power generation.

In one embodiment of the invention a gas turbine has been disclosed having a rotor mounted for rotation within a turbine casing. The rotor includes a shaft and at least first stage and second stage rotor discs axially displaced on the rotor shaft to form an interstage disc cavity therebetween. The rotor includes a plurality of rotor blades extending radially outward from each of the rotor discs into a main gas flow. The turbine includes a stator having a plurality of stages, a first of the stator stages extending radially inward to the interstage disc cavity from the turbine casing toward the rotor shaft. Each of the stator stages includes multiple stator vanes axially aligned with the rotor blades in the main gas flow and terminating radially inwardly with a seal housing which provides a seal about the rotor shaft. The first of the stator stages includes an attachment portion connecting the seal housing to at least one stator vane. A combination, comprising the seal housing, the first stage rotor disc, a surface of the first stage rotor disc which faces the seal housing, the second stage rotor disc and a surface of the second stage rotor disc facing the seal housing, form a seal assembly about the interstage disc cavity. The seal housing includes a first portion facing the surface of the first stage rotor disc and a second portion facing the surface of the second stage rotor disc. First and second seal housing flanges each extend outward from the first portion of the seal housing, each extending toward the first surface of the first stage rotor disc. The seal housing flanges may be integrally formed with the seal housing, e.g., via a casting process. Inner and outer rotor flanges each extend outward from the first stage rotor disc along the surface of the first stage rotor disc toward the seal housing of the first of the stator stages. The inner rotor flange and first seal housing flange are positioned radially inward relative to the second seal housing flange and the outer rotor flange is positioned radially outward relative to the second seal housing flange. The outer rotor flange functions as a rim seal. The inner rotor flange and first seal housing flange extend toward one another in close proximity to limit movement of main gas flow along the rotor shaft. The first portion of the seal housing includes a cooling air inlet positioned to inject air in an outer region of the disc cavity between the outer rotor flange and the second seal housing flange.

In a related method, applied to such a gas turbine having at least first stage and second stage rotor discs axially displaced on the rotor shaft to form the interstage disc cavity, at least first and second interconnected flow regions are formed in the disc cavity 13 where the first flow region 52 is positioned radially outward with respect to the second flow region 56 to provide a flow path (52, 54, 56) wherein the first flow region 52 initially receives a portion of the main gas flow before that portion is received by the second flow region 56. A seal, e.g., the labyrinth seal 37, is positioned as the first seal in the flow path. A flow of air, different from the main gas flow, is injected into the flow path (52, 54, 56) so that the portion of the main gas flow which is received by the second flow region 56 is mixed with the flow of air before reaching the first seal 37 in the flow path. Although the first flow region is described by example as the region 52, it may be the region 54 or another flow region of the disc cavity. Similarly the second flow region may be the flow region 54 or another flow region of the disc cavity 13. Further, the first seal, being the first seal in the flow path, may be a seal positioned before the labyrinth seal 37. In the illustrated embodiment, first, second and third interconnected flow regions 52, 54, 56 are formed in the disc cavity 13 to provide the flow path where the first and second flow regions are positioned radially outward with respect to the third flow region so that the second flow region initially receives a portion of the main gas flow before that portion is received by the third flow region, and the first seal is positioned in the third flow region.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the spirit and scope of the appended claims.

The claimed invention is:

1. A gas turbine comprising:

a turbine casing;

a rotor mounted for rotation within the turbine casing and comprising a rotor shaft and at least a first stage upstream rotor disc and a second stage downstream rotor disc axially displaced on the rotor shaft to form an interstage disc cavity therebetween, the rotor having a plurality of rotor blades extending radially outward from the rotor discs into a main gas flow, the second stage rotor disc positioned in a downstream direction with respect main gas flow from the first stage upstream rotor disk;

a stator comprising a plurality of stator stages, a first of the stator stages extending radially inward to the interstage disc cavity from the turbine casing toward the rotor shaft, the plurality of stator stages providing multiple stator vanes axially aligned with the rotor blades in the main gas flow and terminating radially inwardly with a seal housing which provides a seal about the rotor shaft, the first of the stator stages including an attachment portion connecting the seal housing to at least one stator vane, wherein a combination, comprising the seal housing, and the first stage rotor disc, including a surface of the first stage rotor disc which faces the seal housing, and the second stage rotor disc, including a surface of the second stage rotor disc facing the seal housing, form a seal assembly about the interstage disc cavity, the seal housing including a first portion facing the surface of the first stage rotor disc and a second portion facing the first surface of the second stage rotor disc;

first and second seal housing flanges each extending outward from the first portion of the seal housing, each extending toward the surface of the first stage rotor disc;

inner and outer rotor flanges each extending outward from the first stage upstream rotor disk along the surface of the first stage rotor disc toward the first of the stator stages, wherein:

the inner rotor flange and first seal housing flange are positioned radially inward relative to the second seal housing flange and the outer rotor flange is positioned radially outward relative to the second seal housing flange, the outer rotor flange functions as a rim seal, the inner rotor flange and the first seal housing flange extend toward one another in close proximity to limit ingress of main gas flow along the rotor shaft, wherein a portion of the interstage disc cavity between the seal housing and the surface of the first stage rotor disc which faces the seal housing includes at least first and second interconnected flow regions where (i) the first flow region is positioned radially outward with respect to the second flow region so that the first flow region must initially receive a portion of the main gas flow before that portion is received by the second flow region and (ii) the first flow region is between the outer rotor flange and the second seal housing flange and (iii) the second flow region is between the inner rotor flange and the first seal housing flange, and the first portion of the seal housing includes a cooling air inlet positioned to inject air directly into the first flow region of the disc cavity between the outer rotor flange and the second seal housing flange such that air injected directly into the first flow region must flow through the first flow region before flowing into the second flow region.

2. The gas turbine of claim 1 wherein the second seal flange protrudes toward the first surface of the first stage rotor disc so that in the outer region of the disc cavity, when a portion of the main gas flow enters the outer region of the disc cavity, a circular flow occurs in the outer region as air is injected from the cooling air inlet into the outer region.

3. The gas turbine of claim 1 wherein the inner and outer rotor flanges each extend outward along the surface of the first stage rotor disc toward the first portion of the seal housing or toward the attachment portion which connects the seal housing to the stator vane in the first of the stator stages.

4. The gas turbine of claim 1 further including a labyrinth seal positioned to provide a seal between the seal housing and the rotor shaft, the disc cavity including a first inner region bounded by the combination of the inner rotor flange, the first seal flange and the second seal flange, and a second inner region bounded by the first seal housing flange and the labyrinth seal.

5. The gas turbine of claim 4 wherein, when a portion of the main gas flow enters the outer region of the disc cavity, a circular flow occurs in the first inner region.

6. The gas turbine of claim 1 wherein the rotor includes additional rotor discs spaced axially along the rotor shaft to form additional interstage disc cavities, and the stator includes additional stator stages each extending radially inward into an additional interstage disc cavity and having a seal assembly sealing against the rotor shaft.

7. A method for cooling components in a gas turbine of the type having a rotor and a stator, the rotor, mounted for rotation within a turbine casing based on movement of a main gas flow, including a rotor shaft and at least a first stage upstream rotor disc and a second stage downstream rotor discs axially displaced on the rotor shaft to form an interstage disc cavity, the rotor having a plurality of rotor blades extending radially outward from the rotor discs, the stator including a first stage extending radially inward to the interstage disc cavity and terminating radially inwardly with a seal housing which provides a seal about the rotor shaft, first and second seal housing flanges each extending outward from the seal housing and toward the first stage rotor disc, the first stage rotor disc including inner and outer rotor flanges each extending outward therefrom toward the seal housing of the first stage of the stator, the outer rotor flange positioned to function as a rim seal, the method comprising:

forming at least first and second interconnected flow regions in the disc cavity by positioning the inner rotor flange and first seal housing flange radially inward relative to the second seal housing flange and positioning the outer rotor flange radially outward relative to the second seal housing flange, with (i) the first flow region is-positioned radially outward with respect to the second flow region so that the first flow region must initially receives a portion of the main gas flow before that portion is received by the second flow region, and (ii) the first flow region is between the outer rotor flange and the second seal housing flange and (iii) the second flow region is between the inner rotor flange and the first seal housing flange; and injecting a flow of air, different from the main gas flow, directly into the first flow region so that the air injected directly into the first flow region must flow through the first flow region before flowing into the second flow region and the portion of the main gas flow which is received by the second flow region is mixed with the flow of air before reaching the second flow region.

8. The method of claim 7 wherein the seal housing is positioned in the disc cavity, having a seal housing surface spaced away from a surface of the first stage rotor disc, wherein:

the inner rotor flange and first seal housing flange extend toward one another in close proximity to limit movement of main gas flow along the rotor shaft, so that the first flow region is between the outer rotor flange and the second seal housing flange and the second flow region extends between the first and second seal flanges.

9. The method of claim 8 wherein the step of injecting the flow of air is effected by forming a cooling air inlet through the seal housing so that the air is injected in a portion of the first flow region positioned between the outer rotor flange and the second seal housing flange.

* * * * *